US007224251B2

(12) United States Patent
Wang

(10) Patent No.: US 7,224,251 B2
(45) Date of Patent: May 29, 2007

(54) MAGNETIC RETAINING DEVICE FOR MACHINE TOOL

(75) Inventor: Mu Chuan Wang, Taichung (TW)

(73) Assignee: Earth-Chain Enterprise Co., Ltd., Taichung (TW)

( * ) Notice: Subject to any disclaimer, the term of this patent is extended or adjusted under 35 U.S.C. 154(b) by 263 days.

(21) Appl. No.: 10/892,053

(22) Filed: Jul. 16, 2004

(65) Prior Publication Data

US 2006/0012094 A1 Jan. 19, 2006

(51) Int. Cl.
*H01F 7/20* (2006.01)

(52) U.S. Cl. ..... 335/285; 269/8

(58) Field of Classification Search ..... 335/285; 269/8

See application file for complete search history.

(56) References Cited

U.S. PATENT DOCUMENTS 4,250,478 A * 2/1981 Cardone et al. ..... 335/288
6,854,777 B2 * 2/2005 Jung ..... 294/65.5

* cited by examiner

*Primary Examiner*—K. Lee
*Assistant Examiner*—Bernard Rojas
(74) *Attorney, Agent, or Firm*—Charles E. Baxley

(57) ABSTRACT

A magnetic retaining device for attaching a work piece to a machine tool includes a magnetic housing having two housing members secured together and having different magnetic poles, and a magnetic core rotatably received in the magnetic housing and having two core members having different magnetic poles. The magnetic force of the housing members may be offset by the core members when the core members are received in the housing members of different magnetic poles, and may be increased when the core members are received in the housing members of the same magnetic poles, in order to selectively and stably retain the work piece to the machine tool.

16 Claims, 13 Drawing Sheets

MAGNETIC RETAINING DEVICE FOR MACHINE TOOL

BACKGROUND OF THE INVENTION

1. Field of the Invention

The present invention relates to a magnetic retaining or grasping device, and more particularly to a magnetic retaining or grasping device for stably grasping or holding or retaining work pieces to machines or machine tools, and for allowing the work pieces to be effectively worked or machined by the machines or machine tools.

2. Description of the Prior Art

Typical machines or machine tools may comprise one or more clamping vices or other retaining or grasping devices for grasping or holding or retaining work pieces to the machines or machine tools, and for allowing the work pieces to be worked or machined by the machines or machine tools.

However, it is required to thread and to unthread a number of fasteners, to clamp or secure the work pieces to the machines or machine tools, such that it is difficult and it may take a long time to secure and to disengage the work pieces from the machines or machine tools.

The other typical machines or machine tools may comprise one or more magnetic retaining or grasping devices for magnetically grasping or holding or retaining the work pieces to the machines or machine tools.

However, the typical magnetic retaining or grasping devices comprise one or more magnetic members secured together in series that may not be used to firmly attach or secure the work pieces to the machines or machine tools, such that the work pieces may be easily moved relative to the machines or machine tools and may not be effectively worked or machined by the machines or machine tools.

The present invention has arisen to mitigate and/or obviate the afore-described disadvantages of the conventional magnetic retaining or grasping devices.

SUMMARY OF THE INVENTION

The primary objective of the present invention is to provide a magnetic retaining or grasping device for stably grasping or holding or retaining work pieces to machines or machine tools, and for allowing the work pieces to be effectively worked or machined by the machines or machine tools.

In accordance with one aspect of the invention, there is provided a magnetic retaining device for attaching a work piece to a machine tool, the magnetic retaining device comprising a magnetic housing including a first and a second housing members secured together and spaced away from each other, and having different magnetic poles, the magnetic housing including a chamber formed therein, and a magnetic core rotatably received in the chamber of the magnetic housing, and including a first and a second core members having different magnetic poles, and the magnetic poles of the first and the second core members of the magnetic core being the same as that of the first and the second housing members of the magnetic housing. A magnetic force of the first and the second housing members of the magnetic housing may be offset by the first and the second core members of the magnetic core when the first and the second core members of the magnetic core are received in the second and the first housing members of the magnetic housing respectively, and may be increased when the first and the second core members of the magnetic core are received in the first and the second housing members of the magnetic housing respectively, in order to solidly or stably attract or secure or retain or grasp the work piece to the machine tool, and to allow the work piece to be effectively worked or machined by the tool members of the machine tool.

The magnetic core includes at least one spacer disposed between the first and the second core members, to space the first and the second core members away from each other. The magnetic core may further include at least one magnetic member disposed between the first and the second core members, to allow the magnetic fields or magnetic fluxes to be transmitted through the magnetic member or transmitted between the first and the second core members.

The magnetic core may further include at least one end plate secured to the first and the second core members, to secure the first and the second core members together.

The magnetic housing includes at least one end cap secured to the first and the second housing members, to stably or to solidly secure the first and the second housing members together, the end plate includes a pin extended therefrom and engageable with the end cap, to limit the magnetic core to rotate relative to the magnetic housing.

For example, the end cap of the magnetic housing includes a passage formed therein, to slidably receive the pin of the end plate. The passage of the end cap of the magnetic housing may include a semi-circular shape. The end plate includes a shank extended therefrom and extendible out through the end cap of the magnetic housing.

A second magnetic retaining device may further be provided and may include a magnetic core rotatably received in a magnetic housing and having a shank extended out of the magnetic housing, and a socket coupled to the shanks of the magnetic retaining device and the second magnetic retaining device, to allow the magnetic cores of the two magnetic retaining device to be rotated in concert with each other.

The magnetic housing includes at least one beam secured thereto, to protect and to reinforce the magnetic housing, and to prevent the magnetic housing from being damaged or scraped by the work piece or other objects.

The magnetic housing may further include at least one spacer disposed between the first and the second housing members, and may further include at least one magnetic member disposed between the first and the second housing members, to allow the magnetic fields or magnetic fluxes to be transmitted through the magnetic member or transmitted between the first and the second housing members.

The magnetic housing includes at least one fastener securing the first and the second housing members together. For example, the magnetic housing includes a spacer through which the fastener is engaged.

Each of the first and the second housing members of the magnetic housing includes a lower portion having a notch formed therein, to decrease a bottom surface of the lower portion thereof, and to increase a magnetic force or a magnetic strength of an upper portion of each of the housing members of the magnetic housing, in order to firmly or stably support or secure the work piece to the machine tool.

One or more brackets may further be provided to secure the magnetic housing to the machine tool, the bracket may be engaged into the notch of the magnetic housing, to stably secure the magnetic housing to the machine tool. Each of the first and the second housing members of the magnetic housing may further include an upper portion having a harder peg engaged therein, to reinforce the upper portion of the magnetic housing.

The magnetic housing includes at least one table secured on the first and the second housing members, for engaging with the work piece and for preventing the magnetic housing from being damaged or scraped by the work piece or other objects. A base panel may further be provided and secured to the magnetic housing, for separating the magnetic housing from the machine tool and for preventing magnetic fields or magnetic fluxes from being transmitted through the base panel, or transmitted between the magnetic housing and the machine tool.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
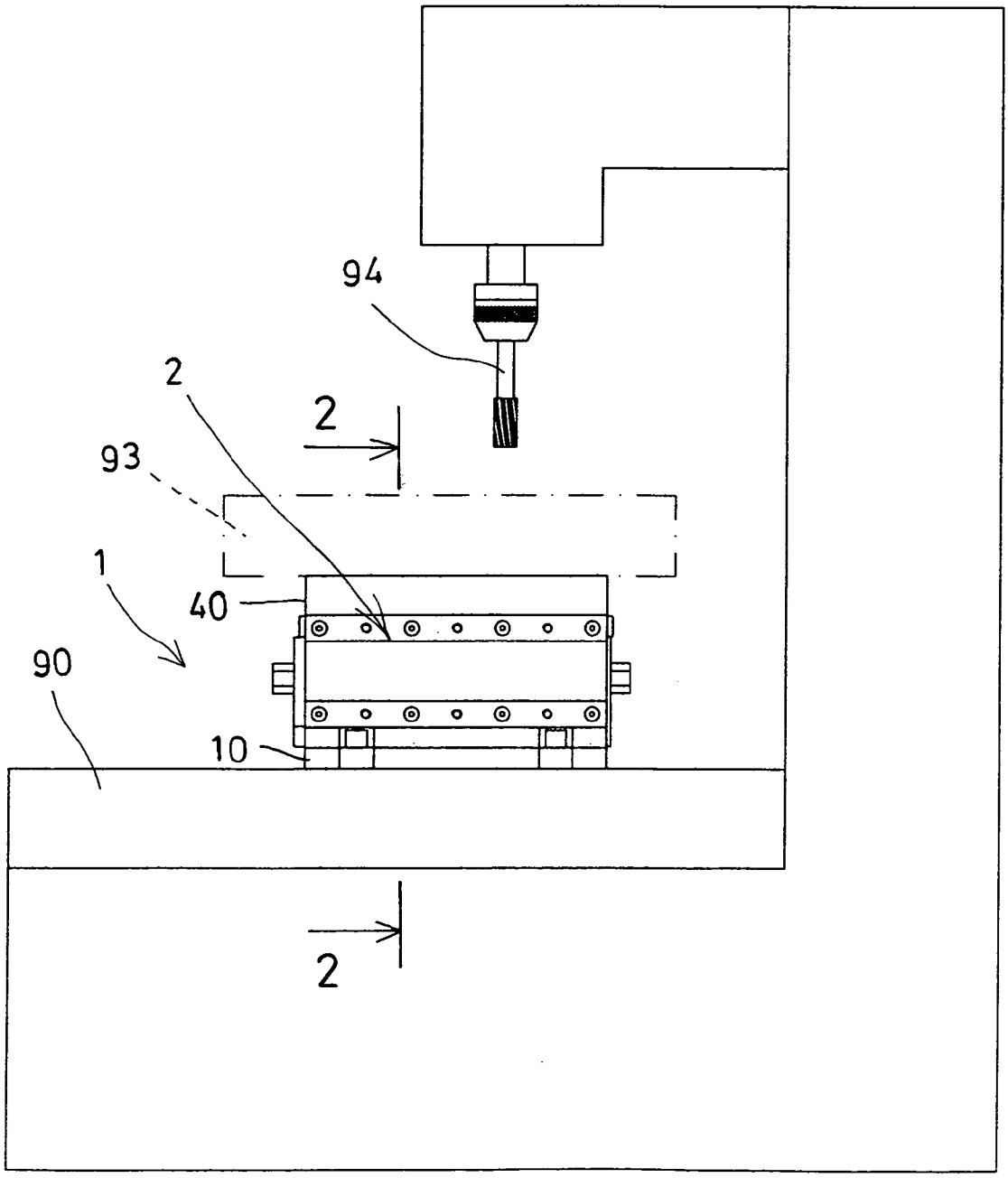
FIG. 1 is a plan schematic view illustrating an attachment of a magnetic retaining or grasping device in accordance with the present invention to a machine or machine tool.
Figure 2:
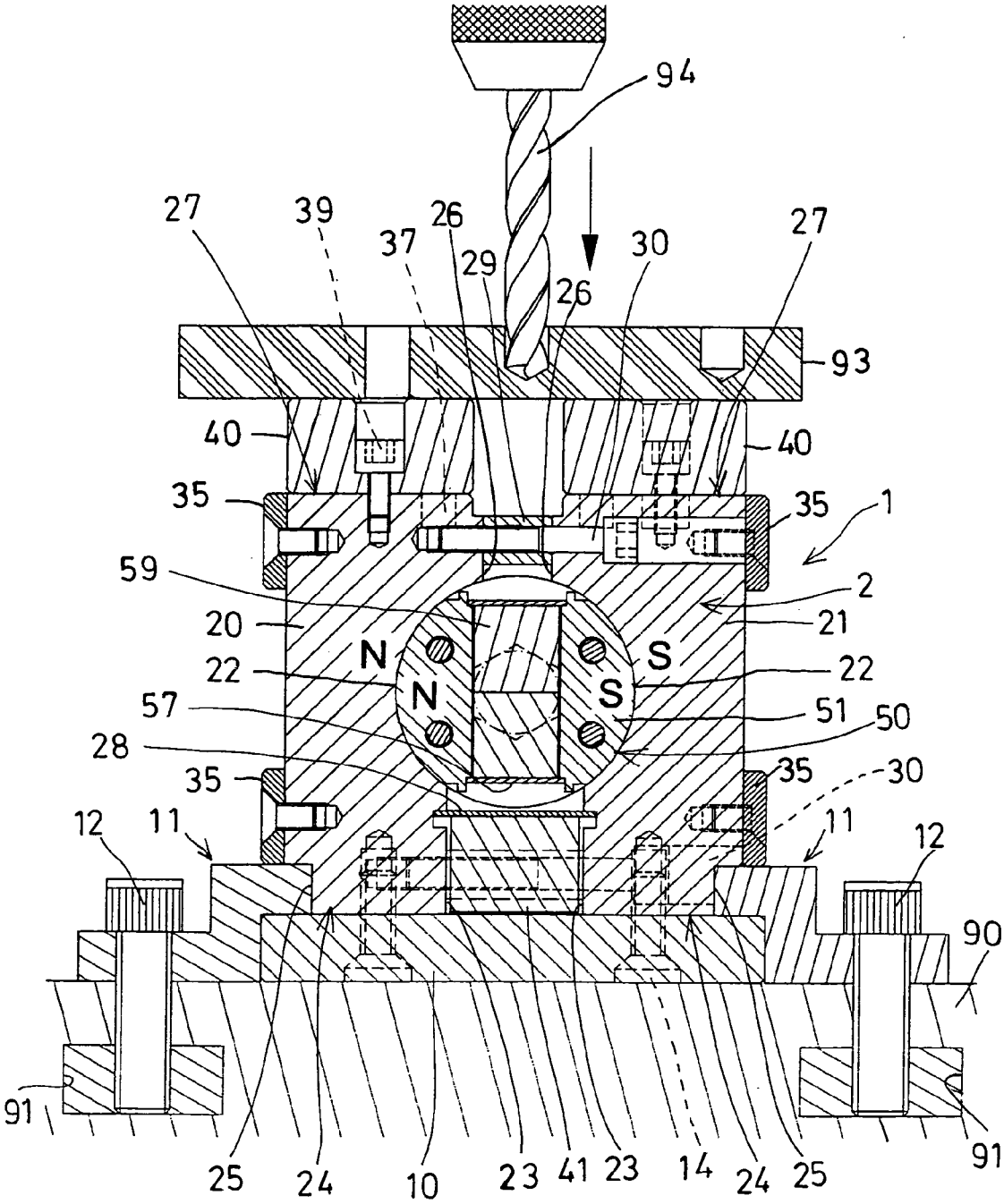
FIG. 2 is a cross sectional view taken along lines 2—2 of FIG. 1.

Referring to the drawings, and initially to FIGS. 1 and 2, a magnetic retaining or grasping device 1 in accordance with the present invention comprises a base panel 10 for securing to a machine or machine tool 90, such as to one or more channels 91 of the machine or machine tool 90 with one or more brackets 11 and one or more fasteners 12.

Figure 8:
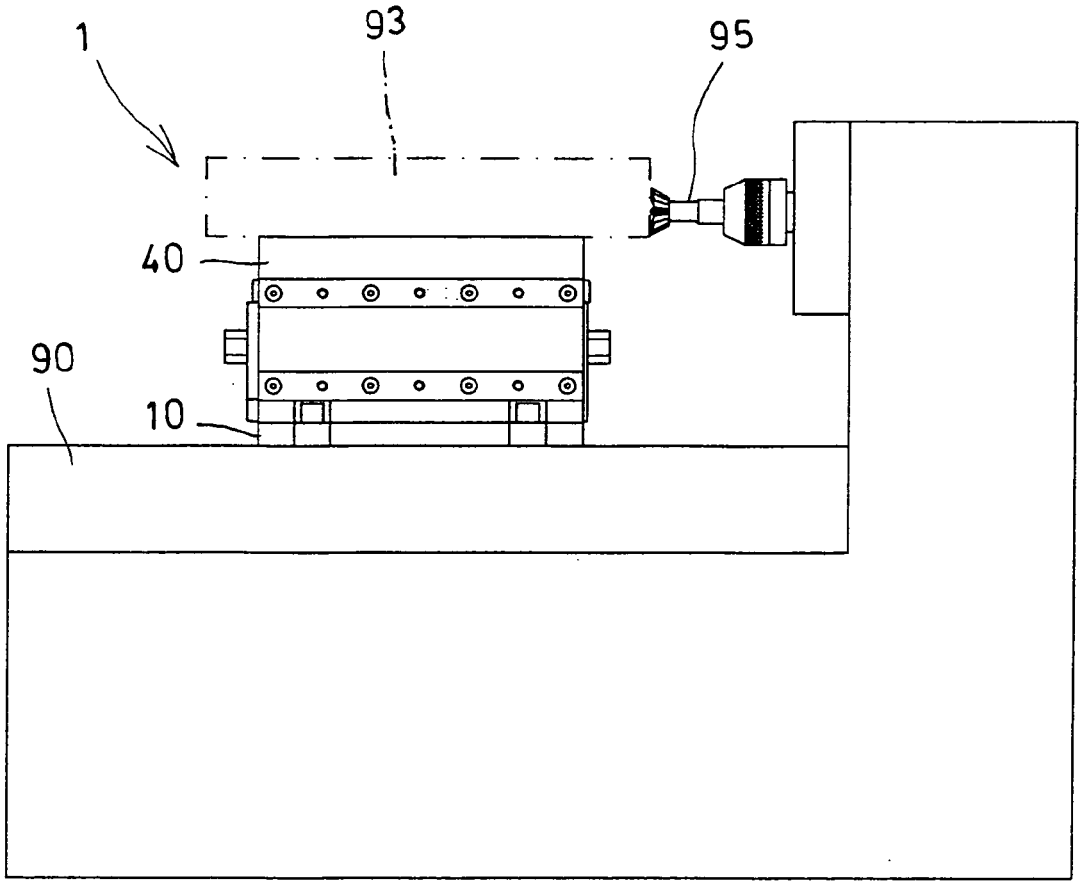
FIGS. 8, 9, 10 are plan schematic views similar to FIG. 1, illustrating the attachment of the magnetic retaining or grasping device in accordance with the present invention to the other machines or machine tools.

For example, as shown in FIGS. 1–2 and 8, the magnetic retaining or grasping device 1 may be used to firmly or stably support one or more work pieces 93 horizontally on the machine or machine tool 90, for allowing the work pieces 93 to be effectively worked or machined by the drilling tools 94 (FIGS. 1–2), the milling tools 95 (FIG. 8), or the like of the machine or machine tool 90.

Figure 9:
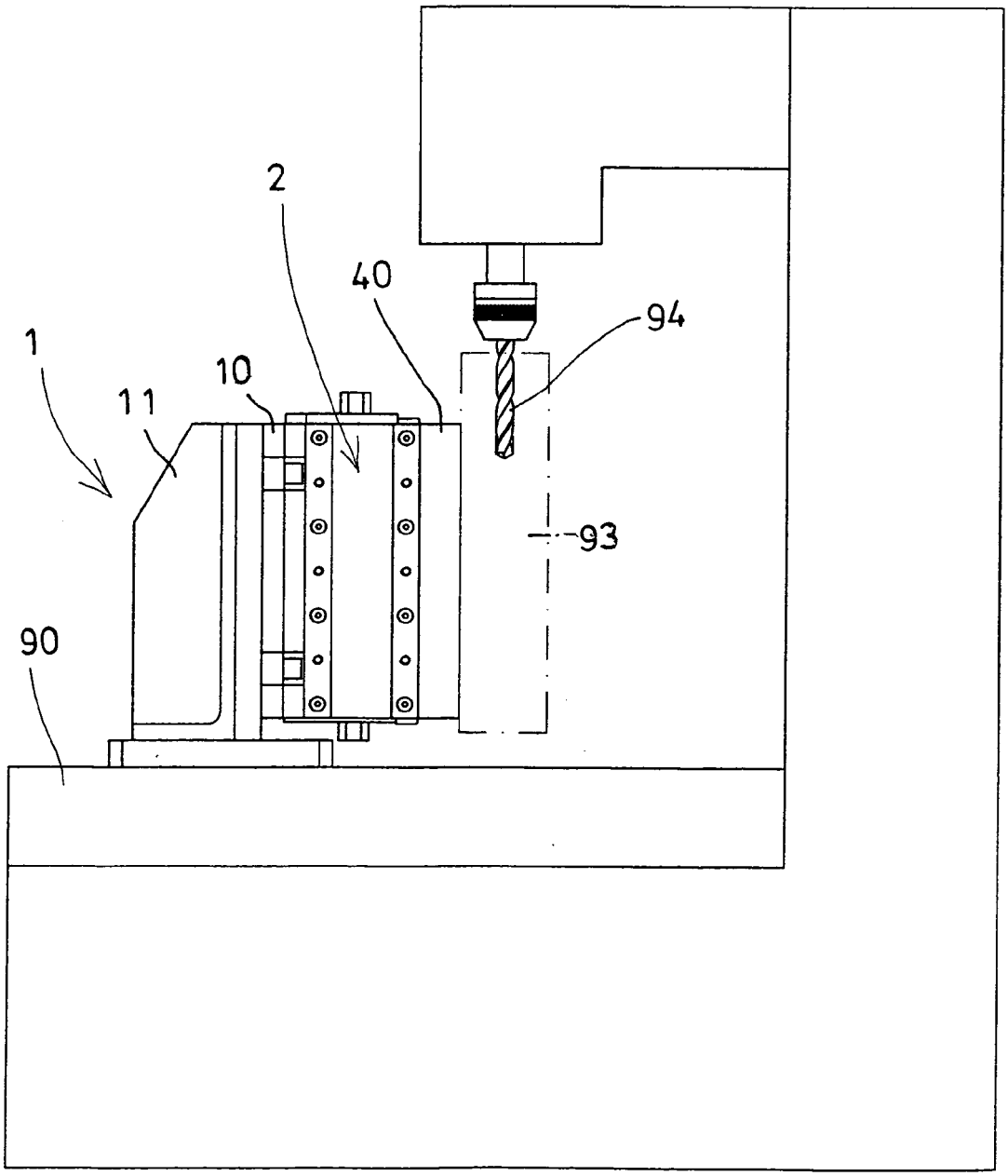
Figure 10:
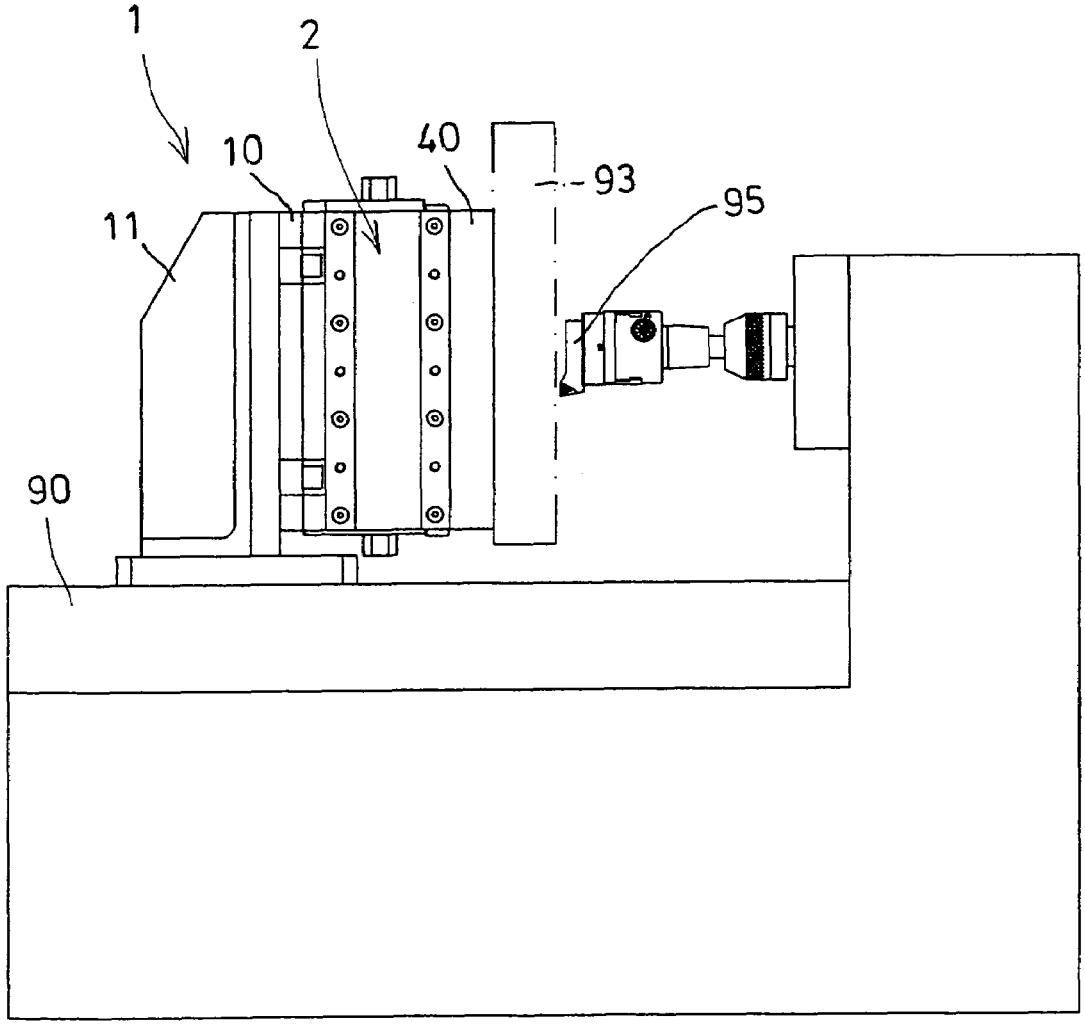
Figure 11:
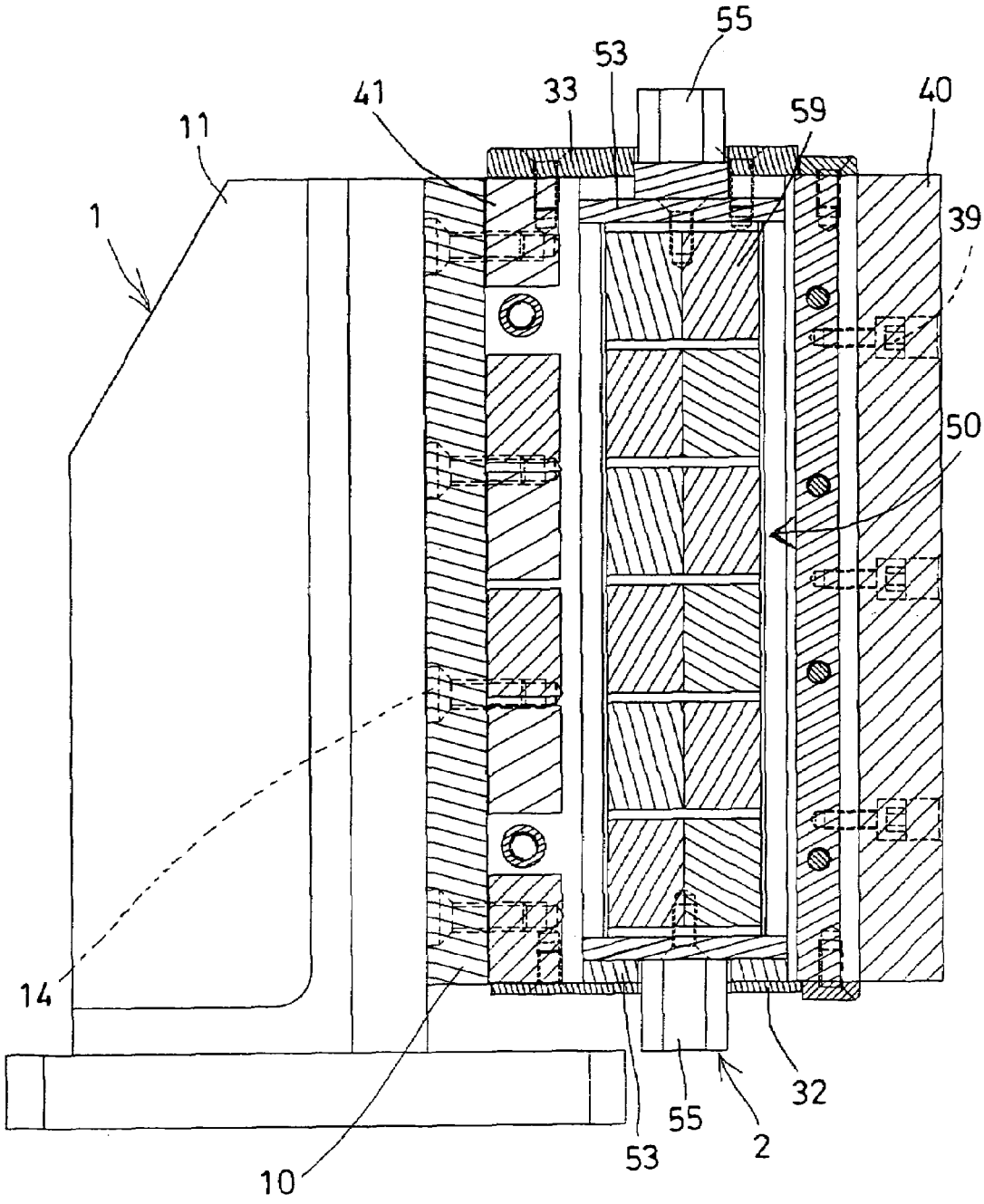
FIG. 11 is a partial cross sectional view of the magnetic retaining or grasping device as shown in FIGS. 9 and 10.

Alternatively, as shown in FIGS. 9–11, the magnetic retaining or grasping device 1 may also be used to firmly or stably support one or more work pieces 93 vertically on the machine or machine tool 90, for allowing the work pieces 93 to be effectively worked or machined by the drilling tool 94 (FIG. 9), the milling tool 95 (FIG. 10, or the like of the machine or machine tool 90.

The base panel 10 includes one or more holes 13 formed therein (FIG. 3) for receiving fasteners 14 which may be used to secure a magnetic housing 2 on top of the base panel 10. The base panel 10, the brackets 11, and the fasteners 12, 14 are preferably made of non-magnetic materials, such as stainless steel materials, aluminum materials, copper materials, or the like, to separate or to isolate the magnetic housing 2 from the machine or machine tool 90 and to prevent the magnetic housing 2 from magnetic loss to the machine or machine tool 90.

Figure 5:
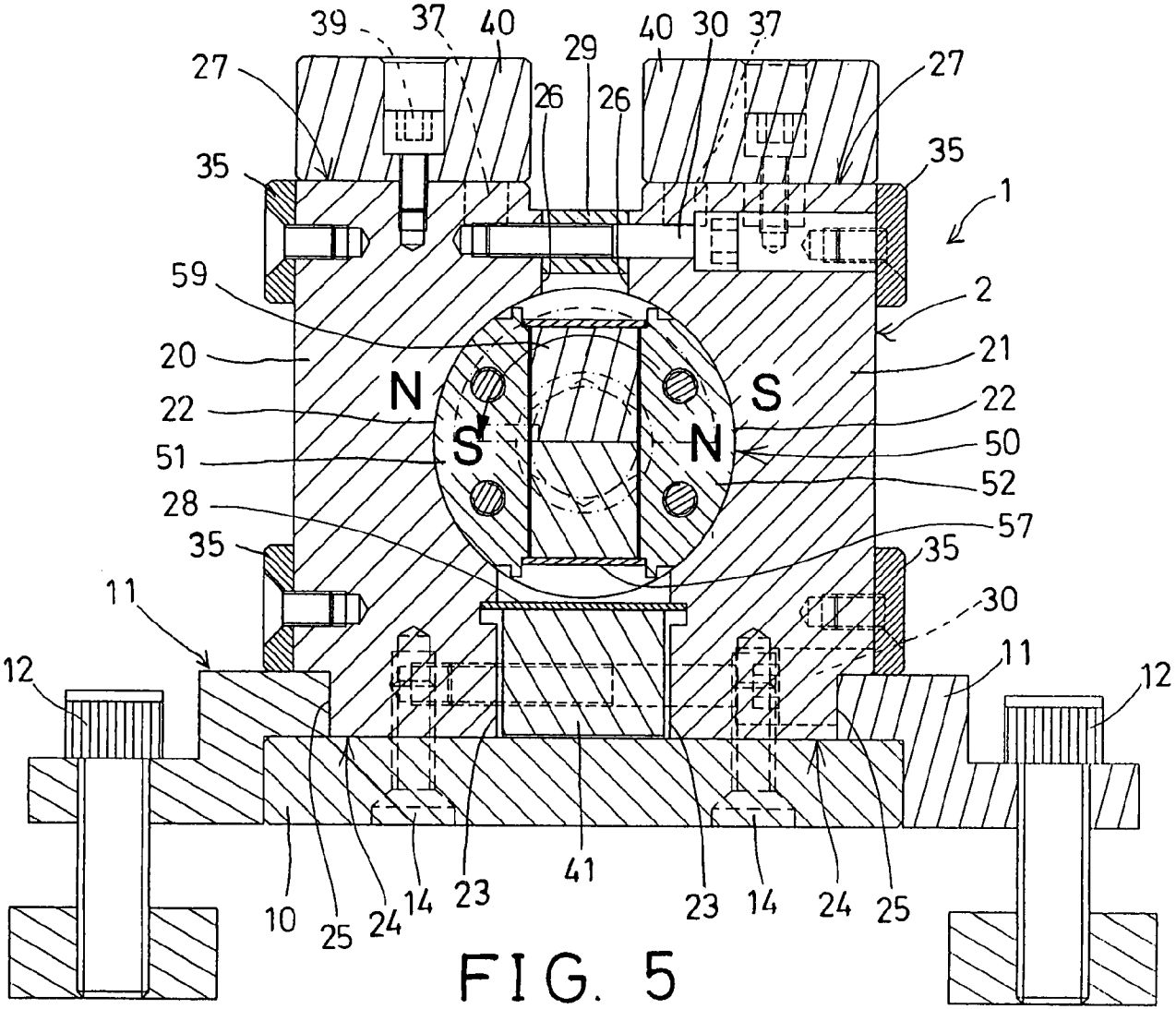
FIG. 5 is a cross sectional view taken along lines 5—5 of FIG. 4.
Figure 6:
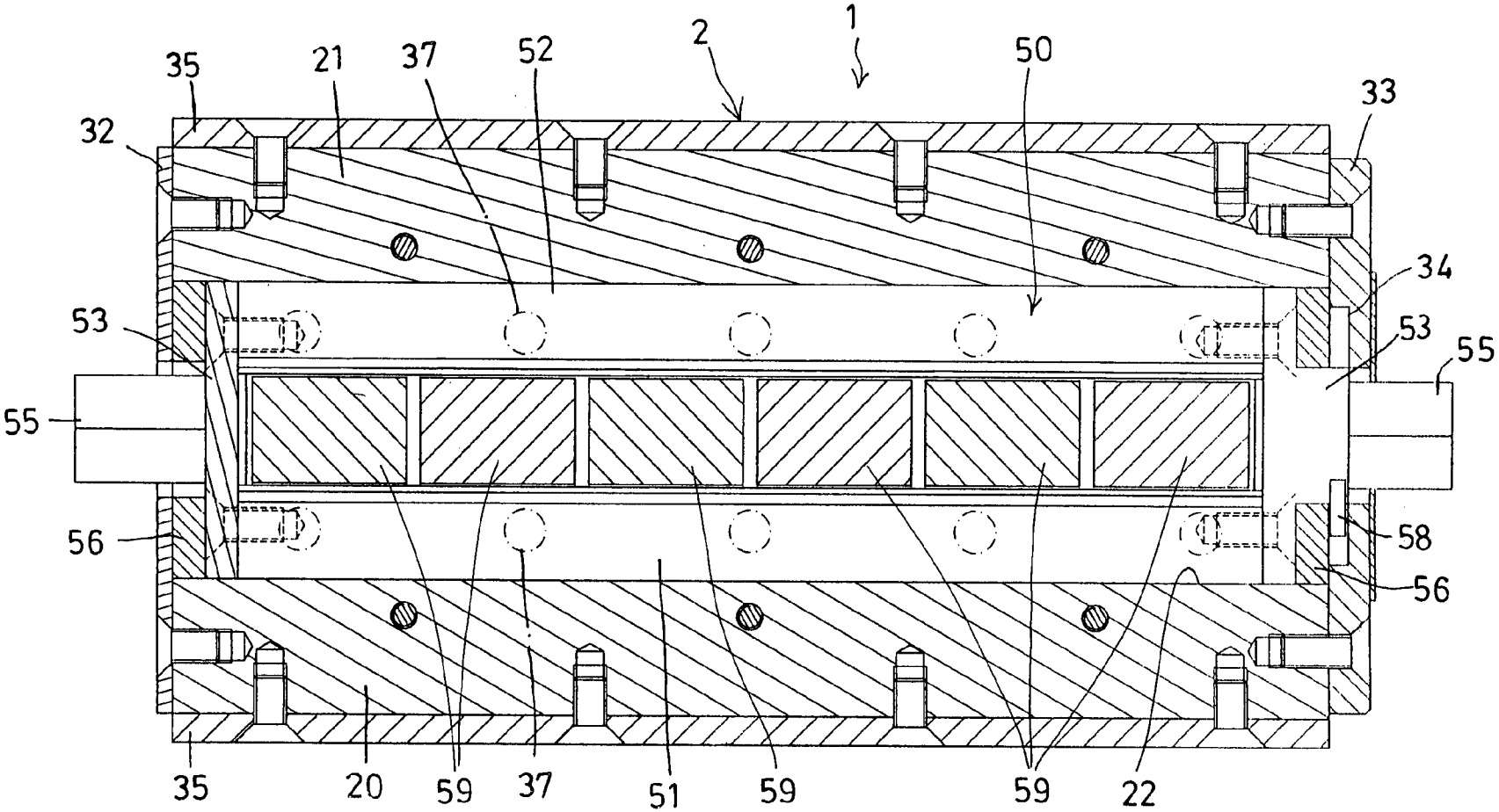
FIG. 6 is a cross sectional view taken along lines 6—6 of FIG. 4.
Figure 7:
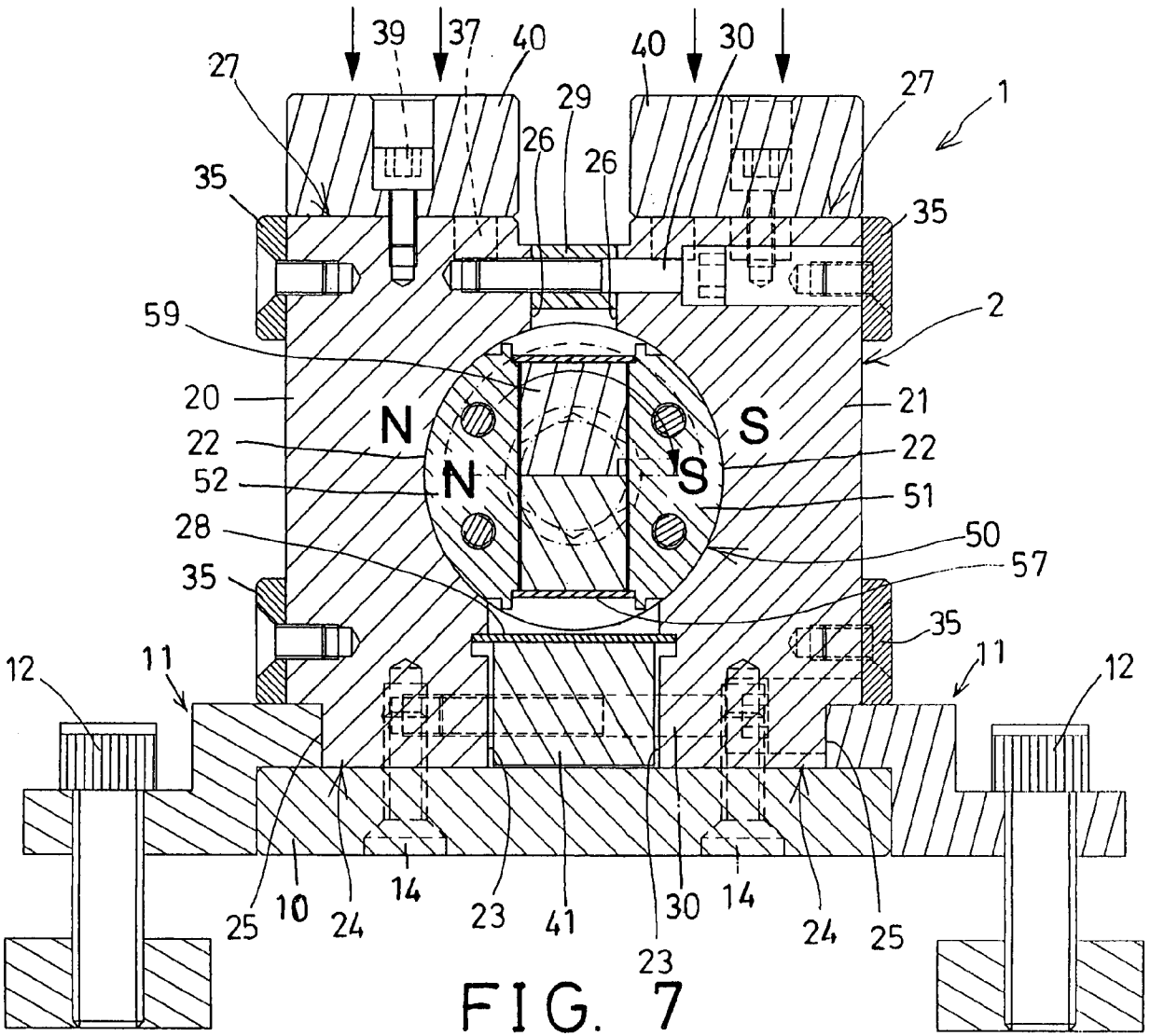
FIG. 7 is a cross sectional view similar to FIG. 5, illustrating the operation of the magnetic retaining or grasping device.

As shown in FIGS. 2–6, the magnetic housing 2 of the magnetic retaining or grasping device 1 may include two housing members 20, 21 which may be secured together and which may be spaced away from each other, and the two housing members 20, 21 include different magnetic poles, such as N-pole and S-pole respectively, best shown in FIGS. 2, 5 and 7.

The magnetic housing 2 includes a circular or cylindrical chamber 22 formed therein. For example, each of the two housing members 20, 21 includes a semi-circular or semi-cylindrical recess 22 formed therein, to form or define the circular or cylindrical chamber 22 of the magnetic housing 2. The two housing members 20, 21 are made of magnetic materials, such as low carbon soft metal materials.

Each of the two housing members 20, 21 includes a flat and vertical surface 23 formed in inner portion of the lower portion 24 thereof, and another flat and vertical surface 26 formed in inner portion of the upper portion 27 thereof; and includes a cut notch 25 formed in outer portion of the lower portion 24 thereof, to decrease the bottom surface of the lower portion 24 thereof, and thus to allow the upper portion 27 thereof to have greater magnetic forces or strengths. The brackets 11 may be engaged into the cut notches 25 of the housing members 20, 21.

One or more spacers 28, 29 may be disposed or engaged between the lower portion 24 and the upper portion 27 of the housing members 20, 21 respectively, and offset from the circular or cylindrical chamber 22 of the magnetic housing 2, to suitably the housing members 20, 21 away from each other. The housing members 20, 21 may be solidly secured together with fasteners 30 which may be engaged through spacers 31.

Figure 3:
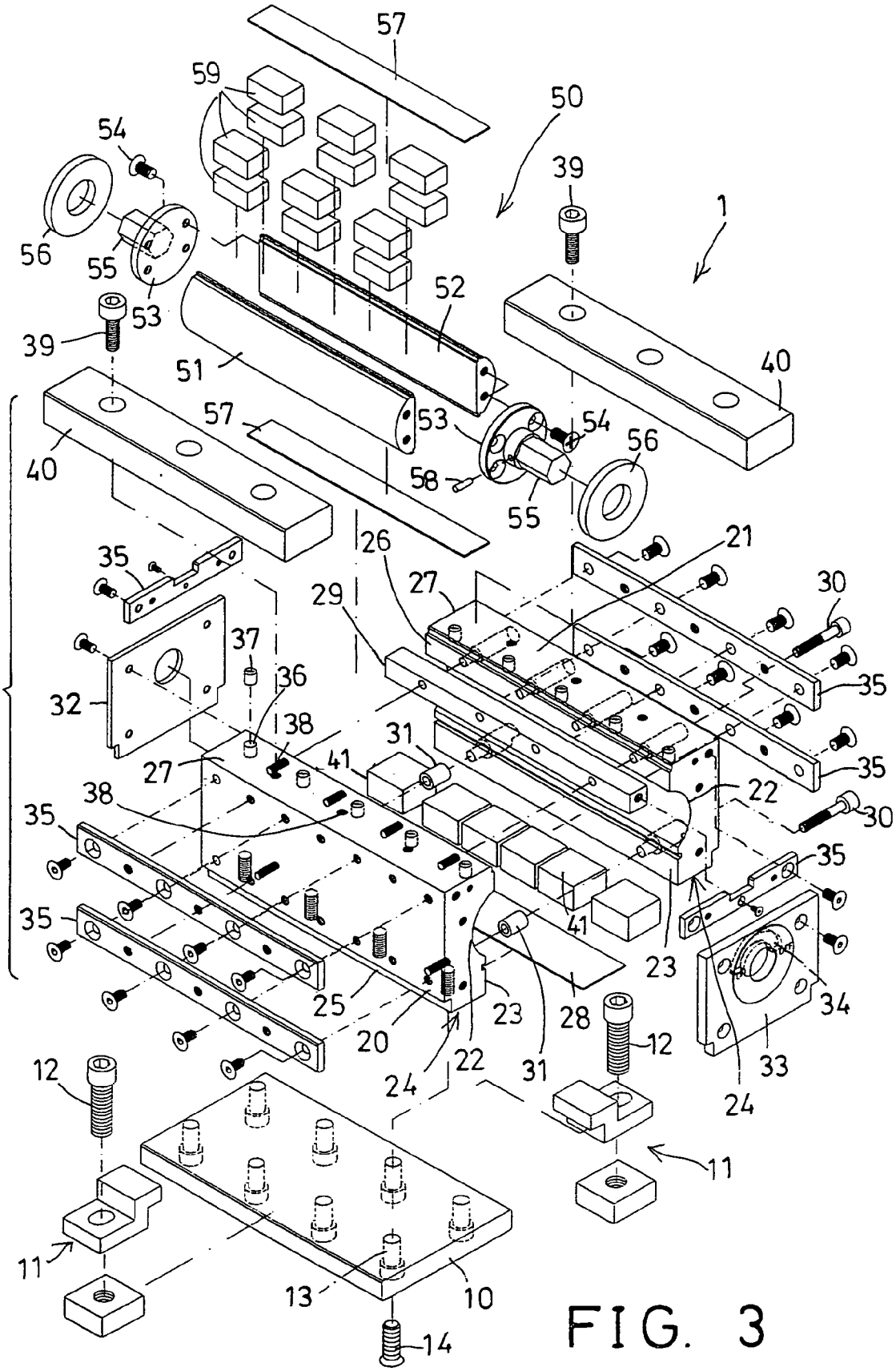
FIG. 3 is an exploded view of the magnetic retaining or grasping device.
Figure 4:
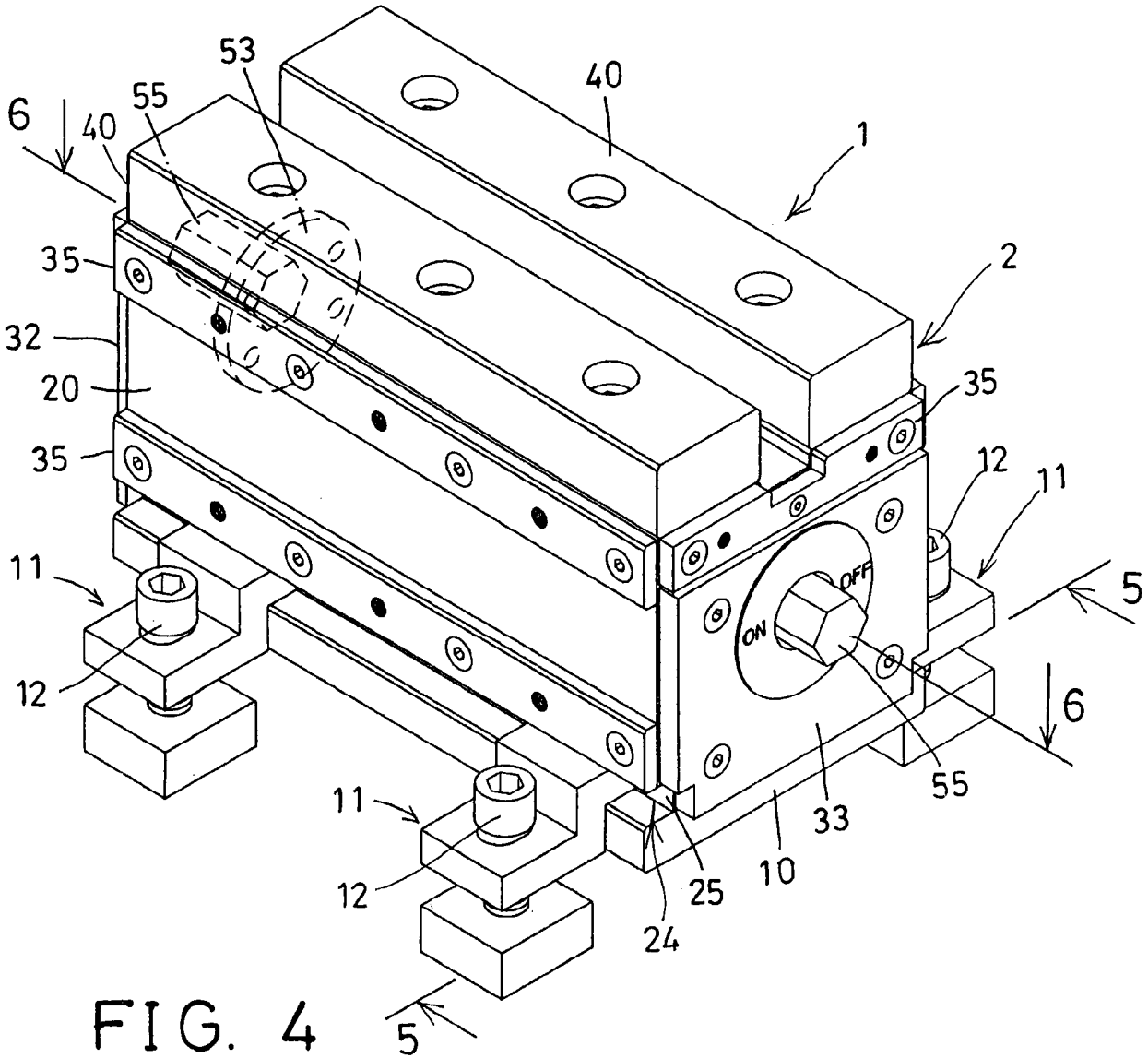
FIG. 4 is a perspective view of the magnetic retaining or grasping device.

One or more, such as two end caps 32, 33 may further be provided and engaged or secured onto the ends of the magnetic housing 2 or of the housing members 20, 21 respectively, to further solidly secure the housing members 20, 21 together. One of the end caps 33 includes a semi-circular passage 34 formed therein (FIGS. 3, 6).

The magnetic housing 2 or the housing members 20, 21 are made of magnetic materials, such as low carbon soft metal materials, and will thus be easily scraped or damaged by the work pieces 93 or other objects. For protecting the magnetic housing 2 or the housing members 20, 21, one or more beams 35 of greater hardness may further be provided and secured onto the outer peripheral portion of the magnetic housing 2 or of the housing members 20, 21, to protect and to reinforce the magnetic housing 2 or the housing members 20, 21.

It is preferable that each of the housing members 20, 21 of the magnetic housing 2 further includes one or more cavities 36 formed in the upper portion 27 thereof, each for receiving a peg 37 therein. The pegs 37 also include a greater hardness than that of the magnetic housing 2 or of the housing members 20, 21, to protect and to prevent the upper portion 27 of the housing members 20, 21 from being scraped or damaged by other objects.

The spacers 28, 29, 31, the fasteners 30, the end caps 32, 33, the beams 35, and the pegs 37 are also preferably made of non-magnetic materials. Each of the housing members 20, 21 of the magnetic housing 2 further includes one or more screw holes 38 formed in the upper portion 27 thereof (FIG. 3), for threading with fasteners 39 which may be used to secure one or more face boards or tables 40 on top of the magnetic housing 2 or of the housing members 20, 21.

The tables 40 are also made of magnetic materials for attracting or retaining or grasping the work pieces 93 to the magnetic housing 2 of the magnetic retaining or grasping device 1 (FIGS. 1–2 and 9–10). One or more magnetic or permanent magnetic members 41 may further be provided and disposed between the flat surfaces 23 of the housing members 20, 21, and retained in place by the housing members 20, 21 and the base panel 10 and the fasteners 30 and the spacer 28 (FIGS. 2, 5, 7).

The magnetic retaining or grasping device 1 further includes a magnetic core 50 rotatably received in the circular or cylindrical chamber 22 of the magnetic housing 2, and having one or more, such as two core members 51, 52 which may be secured together by non-magnetic end plates 53 and fasteners 54, and which may be spaced away from each other by one or more spacers 57, and the two core members 51, 52 include different magnetic poles, such as S-pole and N-pole respectively, best shown in FIGS. 2, 5 and 7, for acting with the magnetic poles of the housing members 20, 21 respectively.

Each of the end plates 53 includes a shank 55 extended therefrom, and outwardly extended through the end caps 32, 33 of the magnetic housing 2, for allowing the magnetic core 50 to be rotated or driven by driving tools (not shown) or the like. One or more washers 56 may be attached to the shanks 55 and engaged with the housing members 20, 21 and the end caps 32, 33 of the magnetic housing 2. One of the end plates 53 includes a pin 58 extended therefrom (FIGS. 3, 6), and slidably engaged in the semi-circular passage 34 of the end cap 33, to limit the magnetic core 50 to rotate relative to the magnetic housing 2.

For example, when the pin 58 is engaged in one end of the semi-circular passage 34 of the end cap 33, the core members 51, 52 may be rotated and received in the semi-circular or semi-cylindrical recesses 22 of the two housing members 20, 21 respectively (FIG. 5); and the core members 51, 52 may be rotated and received in the other semi-circular or semi-cylindrical recesses 22 of the other housing members 21, 20 respectively (FIGS. 2, 7) when the pin 58 is engaged in the other end of the semi-circular passage 34 of the end cap 33.

It is also preferable that the end plates 53, the fasteners 54, the shanks 55, the washers 56, the spacers 57, and the pin 58 are made of non-magnetic materials, such as stainless steel materials, aluminum materials, copper materials, or the like, to prevent the magnetic forces or magnetic fields of the core members 51, 52 of the magnetic core 50 from being interfered by these elements.

The magnetic core 50 may further include one or more magnetic or permanent magnetic members 59 provided and disposed between the core members 51, 52, and retained in place by the core members 51, 52 and the spacer 57, to allow magnetic fields or magnetic fluxes to be effectively transmitted through the magnetic members 59 or to be effectively transmitted between the core members 51, 52.

In operation, as shown in FIG. 5, when the core members 51, 52 are received in the semi-circular or semi-cylindrical recesses 22 of the two housing members 20, 21 respectively, the opposite magnetic poles of the two core members 51, 52 may be attracted or acted with the magnetic poles of the housing members 20, 21 respectively, to offset or decrease the magnetic force of the core members 51, 52 and the housing members 20, 21, such that the work piece 93 may not be attracted to the magnetic retaining or grasping device 1.

On the contrary, as shown in FIGS. 2 and 7, when the core members 51, 52 are rotated and received in the semi-circular or semi-cylindrical recesses 22 of the other housing members 21, 20 respectively, the magnetic poles of the two core members 51, 52 may be aligned with and acted with the same magnetic poles of the housing members 20, 21 respectively, to combine the magnetic forces of the core members 51, 52 and the housing members 20, 21 together, and thus to provide a great magnetic attracting or sucking force to stably attract or secure the work piece 93 to the magnetic retaining or grasping device 1.

Figure 12:
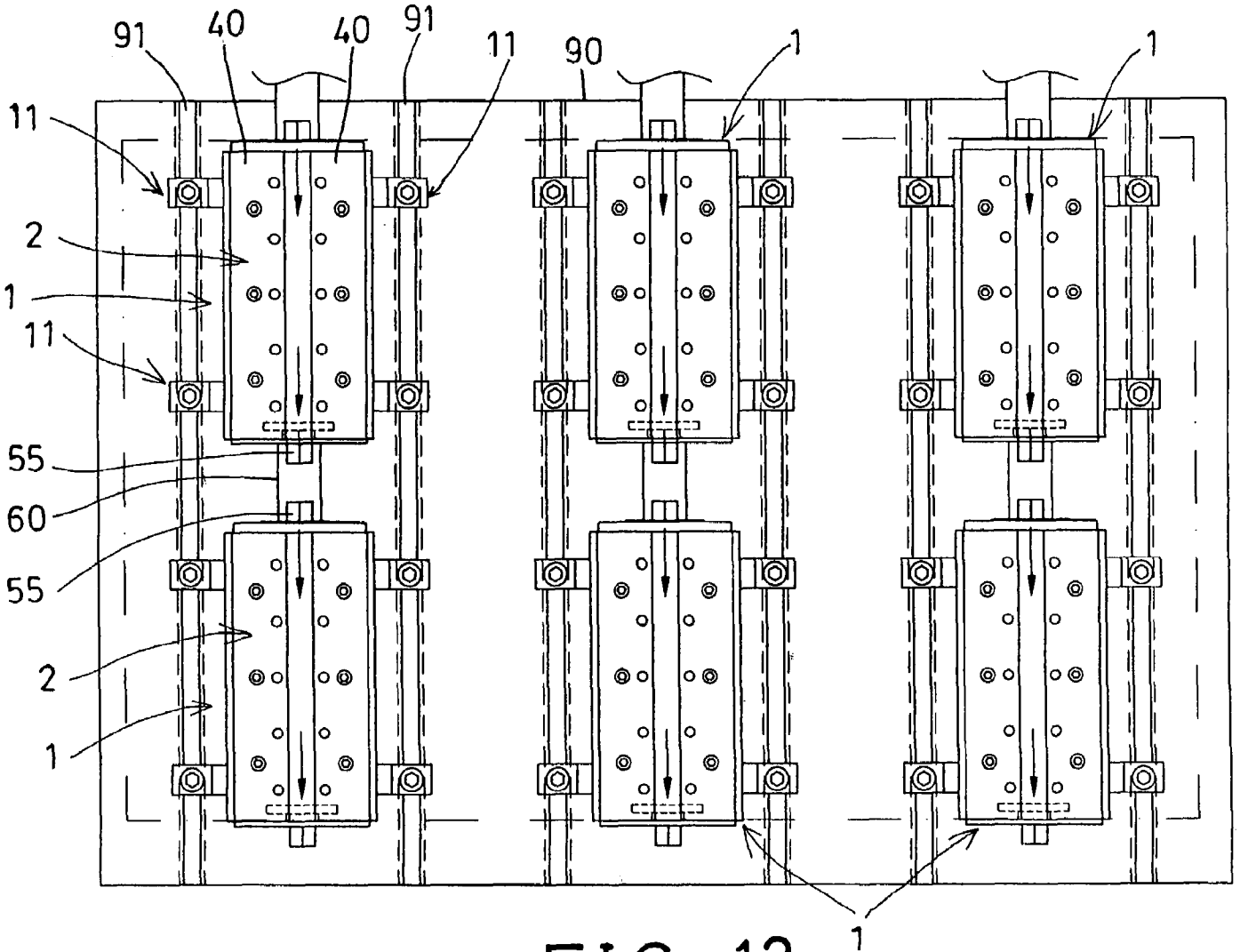
FIGS. 12, 13 are partial top plan schematic views illustrating the attachments of a number of magnetic retaining or grasping devices in accordance with the present invention to the machines or machine tools.
Figure 13:
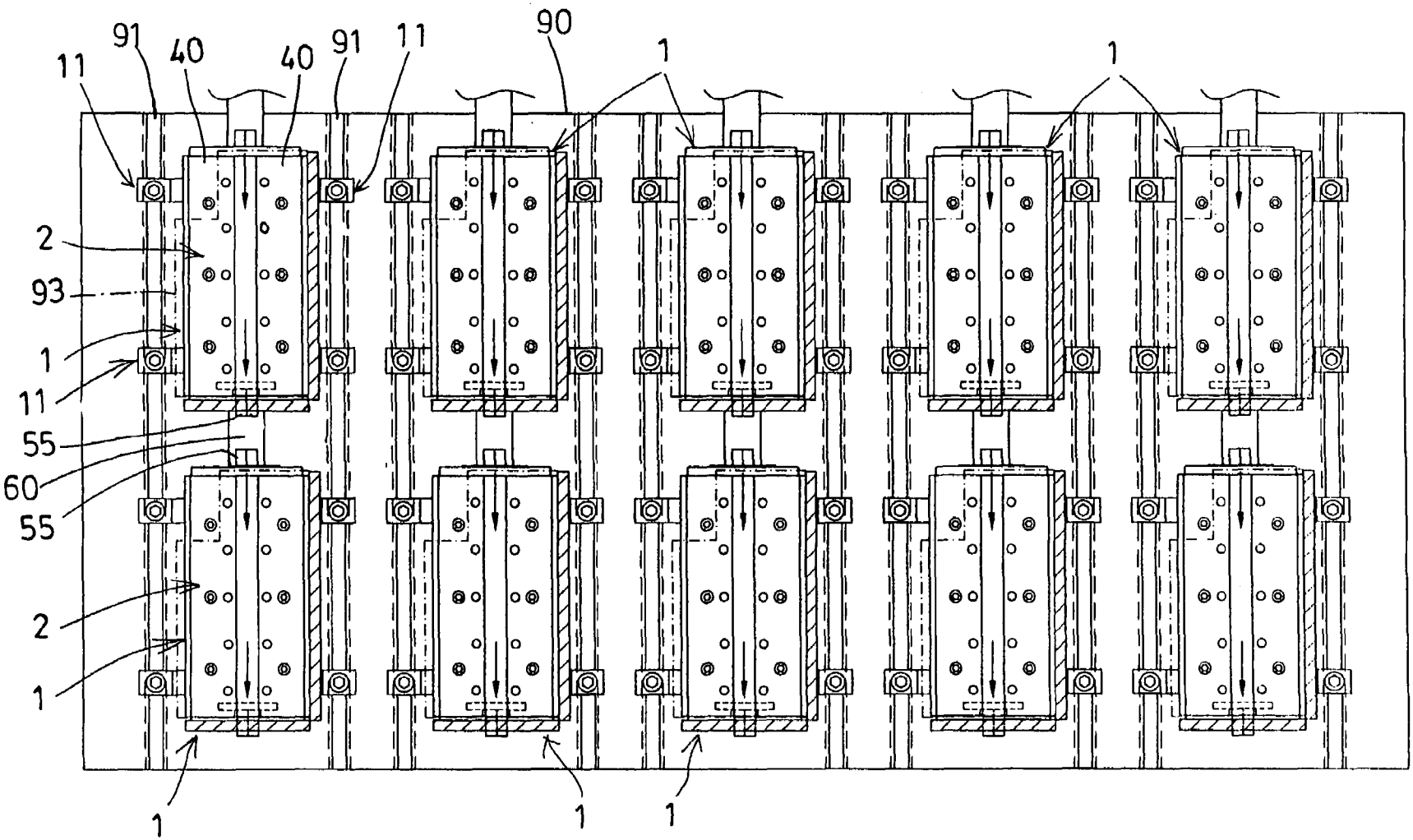

Referring next to FIGS. 12 and 13, two or more magnetic retaining or grasping devices 1 may be attached or secured onto the machine or machine tool 90 with the brackets 11 and the fasteners 12. In addition, the shanks 55 of the magnetic cores 50 of two different magnetic retaining or grasping devices 1 may be coupled or secured together with couplers, sockets 60 or the like, for allowing the magnetic cores 50 to be rotated relative to the magnetic housings 2 respectively, in order to attract or retain a number of work pieces 93 or one or more greater work pieces 93 to the machine or machine tool 90 with the magnetic retaining or grasping devices 1.

Accordingly, the magnetic retaining or grasping device in accordance with the present invention may be used for stably attracting or grasping or holding or retaining or attaching the work pieces to the machines or to the machine tools, and for allowing the work pieces to be effectively worked or machined by the tool members of the machines or the machine tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetic retaining device for attaching a work piece to a machine tool, said magnetic retaining device comprising:

a magnetic housing including a first and a second housing members secured together and spaced away from each other, and having different magnetic poles, said magnetic housing including a chamber formed therein, and each of said first and said second housing members of said magnetic housing including a lower portion having a notch formed therein to decrease a bottom surface of said lower portion thereof, at least one bracket for securing said magnetic housing to the machine tool, said at least one bracket being engaged into said notch of said magnetic housing, and a magnetic core rotatably received in said chamber of said magnetic housing, and including a first and a second core members having different magnetic poles, and the magnetic poles of said first and said second core members of said magnetic core being the same as that of said first and said second housing members of said magnetic housing, a magnetic force of said first and said second housing members of said magnetic housing being offset by said first and said second core members of said magnetic core when said first and said second core members of said magnetic core are received in said second and said first housing members of said magnetic housing respectively, and being increased when said first and said second core members of said magnetic core are received in said first and said second housing members of said magnetic housing respectively.

2. The magnetic retaining device as claimed in claim 1, wherein said magnetic core includes at least one spacer disposed between said first and said second core members.

3. The magnetic retaining device as claimed in claim 1, wherein said magnetic core includes at least one magnetic member disposed between said first and said second core members.

4. The magnetic retaining device as claimed in claim 1, wherein said magnetic core includes at least one end plate secured to said first and said second core members, to secure said first and said second core members together.

5. The magnetic retaining device as claimed in claim 1 further comprising a second magnetic retaining device including a magnetic core rotatably received in a magnetic housing and having a shank extended out of said magnetic housing, and a socket coupled to said shanks of said magnetic retaining device and said second magnetic retaining device.

6. The magnetic retaining device as claimed in claim 1, wherein said magnetic housing includes at least one beam secured thereto, to protect and to reinforce said magnetic housing.

7. The magnetic retaining device as claimed in claim 1, wherein said magnetic housing includes at least one spacer disposed between said first and said second housing members.

8. The magnetic retaining device as claimed in claim 1, wherein said magnetic housing includes at least one magnetic member disposed between said first and said second housing members.

9. The magnetic retaining device as claimed in claim 1, wherein said magnetic housing includes at least one fastener securing said first and said second housing members together.

10. The magnetic retaining device as claimed in claim 9, wherein said magnetic housing includes a spacer through which said at least one fastener is engaged.

11. The magnetic retaining device as claimed in claim 1, wherein said magnetic housing includes at least one table secured on said first and said second housing members.

12. The magnetic retaining device as claimed in claim 1 further comprising a base panel secured to said magnetic housing, for separating said magnetic housing from the machine tool.

13. A magnetic retaining device for attaching a work piece to a machine tool, said magnetic retaining device comprising:

a magnetic housing including a first and a second housing members secured together and spaced away from each other, and having different magnetic poles, said magnetic housing including a chamber formed therein, and a magnetic core rotatably received in said chamber of said magnetic housing, and including a first and a second core members having different magnetic poles, and the magnetic poles of said first and said second core members of said magnetic core being the same as that of said first and said second housing members of said magnetic housing, said magnetic core including at least one end plate secured to said first and said second core members to secure said first and said second core members together, a magnetic force of said first and said second housing members of said magnetic housing being offset by said first and said second core members of said magnetic core when said first and said second core members of said magnetic core are received in said second and said first housing members of said magnetic housing respectively, and being increased when said first and said second core members of said magnetic core are received in said first and said second housing members of said magnetic housing respectively, and said magnetic housing including at least one end cap secured to said first and said second housing members, to secure said first and said second housing members together, said at least one end plate including a pin extended therefrom and engageable with said at least one end cap, to limit said magnetic core to rotate relative to said magnetic housing.

14. The magnetic retaining device as claimed in claim 13, wherein said at least one end cap of said magnetic housing includes a passage formed therein, to slidably receive said pin of said at least one end plate.

15. The magnetic retaining device as claimed in claim 14, wherein said passage of said at least one end cap of said magnetic housing includes a semi-circular shape.

16. A magnetic retaining device for attaching a work piece to a machine tool, said magnetic retaining device comprising:

a magnetic housing including a first and a second housing members secured together and spaced away from each other, and having different magnetic poles, said magnetic housing including a chamber formed therein, and a magnetic core rotatably received in said chamber of said magnetic housing, and including a first and a second core members having different magnetic poles, and the magnetic poles of said first and said second core members of said magnetic core being the same as that of said first and said second housing members of said magnetic housing, said magnetic core including at least one end plate secured to said first and said second core members to secure said first and said second core members together.

a magnetic force of said first and said second housing members of said magnetic housing being offset by said first and said second core members of said magnetic core when said first and said second core members of said magnetic core are received in said second and said first housing members of said magnetic housing respectively, and being increased when said first and said second core members of said magnetic core are received in said first and said second housing members of said magnetic housing respectively, and said magnetic housing including at least one end cap secured to said first and said second housing members, to secure said first and said second housing members together, said at least one end plate including a shank extended therefrom and extendible out through said at least one end cap of said magnetic housing.

* * * * *